US010662856B2

(12) United States Patent
Harada et al.

(10) Patent No.: US 10,662,856 B2
(45) Date of Patent: May 26, 2020

(54) OUTBOARD MOTOR

(71) Applicant: HONDA MOTOR CO., LTD., Tokyo (JP)

(72) Inventors: Yoshihiro Harada, Saitama (JP); Ryohei Matsuoka, Saitama (JP); Kazuhiro Ishizaka, Saitama (JP); Minoru Saito, Saitama (JP); Toru Kimura, Saitama (JP); Naoki Aikawa, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 113 days.

(21) Appl. No.: 16/088,134

(22) PCT Filed: Dec. 1, 2016

(86) PCT No.: PCT/JP2016/085817
§ 371 (c)(1),
(2) Date: Sep. 25, 2018

(87) PCT Pub. No.: WO2017/168839
PCT Pub. Date: Oct. 5, 2017

(65) Prior Publication Data

US 2020/0011228 A1 Jan. 9, 2020

(30) Foreign Application Priority Data

Mar. 31, 2016 (JP) ..... 2016-072049

(51) Int. Cl.
*F01P 1/06* (2006.01)
*B63H 20/32* (2006.01)
*B63H 20/00* (2006.01)

(52) U.S. Cl.
CPC ..... *F01P 1/06* (2013.01); *B63H 20/001* (2013.01); *B63H 20/32* (2013.01)

(58) Field of Classification Search
CPC ..... F01P 1/06; B63H 20/001; B63H 20/32
See application file for complete search history.

(56) References Cited

U.S. PATENT DOCUMENTS 4,692,123 A * 9/1987 Tada ..... F02B 61/045 123/195 P
5,984,742 A * 11/1999 Kimura ..... F02B 61/045 123/196 W (Continued)

FOREIGN PATENT DOCUMENTS

CN 102562250 A 7/2012
CN 103085958 A 5/2013

(Continued)

OTHER PUBLICATIONS

Feb. 21, 2017, International Search Report issued for related PCT application No. PCT/JP2016/085817.

(Continued)

*Primary Examiner* — Lars A Olson
*Assistant Examiner* — Jovon E Hayes
(74) *Attorney, Agent, or Firm* — Paratus Law Group, PLLC

(57) ABSTRACT

An outboard motor 10 includes an engine 16, a fuel tank 25, a propeller 17 which is configured to be driven by the engine 16, a case member 18 which rotatably supports the propeller 17, a recoil starter 29 which is configured to cause the engine 16 to start by manually rotating a crankshaft of the engine 16, and a cover member 16 which is mounted on the case member 18 so as to cover the engine 16, the fuel tank 25, and the recoil starter 29. The recoil starter 29 includes a recoil cover 34, which is formed with an air passage hole 34*c*.

4 Claims, 5 Drawing Sheets

(56) References Cited

U.S. PATENT DOCUMENTS 5,996,561 A * 12/1999 Watanabe ..... F01M 13/022 123/572
5,997,371 A * 12/1999 Oishi ..... F01N 13/12 440/77
6,082,343 A * 7/2000 Oishi ..... F01M 13/022 123/572
6,213,820 B1 * 4/2001 Kanno ..... F02B 61/045 440/1
6,425,362 B1 * 7/2002 Kanno ..... F02B 61/045 123/179.16
6,568,372 B1 * 5/2003 Kanno ..... F02B 61/045 123/491
9,587,599 B2 * 3/2017 Umaoka ..... F02M 35/10222
2007/0068163 A1 * 3/2007 Ishikawa ..... B63H 20/00 60/700
2007/0141924 A1 * 6/2007 Yasuda ..... B63H 20/08 440/87
2012/0160194 A1 6/2012 Yano et al.
2013/0019820 A1 1/2013 Inaba et al.
2013/0109256 A1 5/2013 Harada et al.
2015/0298781 A1 10/2015 Matsumoto
2016/0152313 A1 6/2016 Terazawa et al.
2016/0290294 A1 * 10/2016 Umaoka ..... F02M 35/10222
2017/0122196 A1 * 5/2017 Muramatsu ..... F02B 61/045
2017/0183993 A1 * 6/2017 Ishihara ..... B63H 20/001
2017/0191388 A1 * 7/2017 Ishihara ..... F01M 11/02
2020/0011228 A1 * 1/2020 Harada ..... F01P 1/06

FOREIGN PATENT DOCUMENTS

CN 104797495 A 7/2015
CN 105408201 A 3/2016
JP H11-011391 A 1/1999
JP 2002-309937 A 10/2002
JP 2009-203915 A 9/2009

OTHER PUBLICATIONS

Feb. 21, 2017, International Search Opinion issued for related PCT application No. PCT/JP2016/085817.
Aug. 5, 2019, Canadian Office Action issued for related CA Application No. 3,018,534.
Sep. 4, 2019, Chinese Office Action issued for related CN Application No. 201680084177.1.

* cited by examiner

OUTBOARD MOTOR

CROSS REFERENCE TO PRIOR APPLICATION

This application is a National Stage Patent Application of PCT International Patent Application No. PCT/JP2016/085817 (filed on Dec. 1, 2016) under 35 U.S.C. § 371, which claims priority to Japanese Patent Application No. 2016-072049 (filed on Mar. 31, 2016), which are all hereby incorporated by reference in their entirety.

TECHNICAL FIELD

The present invention relates to an outboard motor mounted on a stem of a hull.

BACKGROUND ART

There has been known an outboard motor which accommodates a fuel tank and a recoil starter inside a cover member which covers an engine. For example, Patent Document 1 discloses an outboard motor in which a fuel tank is accommodated inside a cover member, an air inlet is formed at a connecting portion between the cover member and a case member, and the fuel tank is cooled by air (outside air) taken from the air inlet.

PRIOR ART DOCUMENT

Patent Document

JP-A-H11-11391

SUMMARY OF THE INVENTION

Problems to be Solved by the Invention

Since this kind of outboard motor accommodates heat generating components such as an ignition coil and a fuel pump which becomes a relatively high temperature inside the cover member, it is also desirable to cool these heat generating components with the air taken from the air inlet. However, the air taken from the air inlet might stagnate in the outboard motor which accommodates the fuel tank, the recoil starter, or the like inside the cover member, so that the fuel tank and the heat generating components could not be efficiently cooled.

The present invention provides an outboard motor which can suppress stagnation of air inside a cover member and efficiently cool components accommodated inside the cover member.

Means for Solving the Problems

The present invention provides the following aspects.

According to a first aspect, there is provided an outboard motor (for example, an outboard motor 10 in an embodiment which will be described later) including:

an engine (for example, an engine 16 in the embodiment which will be described later);

a fuel tank (for example, a fuel tank 25 in the embodiment);

a propeller which is configured to be driven by the engine (for example, a propeller 17 in the embodiment);

a case member which rotatably supports the propeller (for example, a case member 18 in the embodiment);

a recoil starter which is configured to cause the engine to start by manually rotating a crankshaft of the engine (for example, a recoil starter 29 in the embodiment); and a cover member which is mounted on the case member so as to cover the engine, the fuel tank, and the recoil starter (for example, a cover member 19 in the embodiment), wherein the recoil starter includes a recoil cover example, a recoil cover 34 in the embodiment), and wherein the recoil cover is formed with an air passage hole (for example, an air passage hole 34*c* in the embodiment).

According to a second aspect, in the outboard motor of the first aspect, the recoil cover includes an extension portion (for example, an extension portion 34*b* in the embodiment) which covers at least a part of an upper side of the fuel tank, and the extension portion is formed with the air passage hole.

According to a third aspect, in the outboard motor of the second aspect, the extension portion is formed in a tubular shape such that a rope (for example, a rope 32 in the embodiment), one end of which is connected to a starter reel (for example, a starter reel 31 in the embodiment) of the recoil starter, can be inserted therethrough, and the air passage hole is formed in a surface of the extension portion facing the fuel tank and an upper surface of the extension portion.

Effects of the Invention

According to the first aspect, since the air taken inside the cover member is supplied to the engine (carburetor) through the air passage hole of the recoil cover, it is possible to suppress stagnation of the air due to the recoil cover and efficiently cool the components accommodated inside the cover member.

According to the second aspect, since the recoil cover includes the extension portion which covers at least a part of the upper side of the fuel tank, and the air passage hole is formed in the extension portion, it is possible to suppress the stagnation of the air due to the extension portion of the recoil cover and efficiently cool the components accommodated inside the cover member.

According to the third aspect, since the extension portion of the recoil cover is formed in the tubular shape such that the rope, one end of which is connected to the starter reel of the recoil starter, can be inserted therethrough, and the air passage hole is formed in the surface of the extension portion facing the fuel tank and the upper surface of the extension portion, it is possible to reliably suppress the stagnation of the air due to the extension portion of the recoil cover.

DESCRIPTION OF EMBODIMENTS

Figure 1:
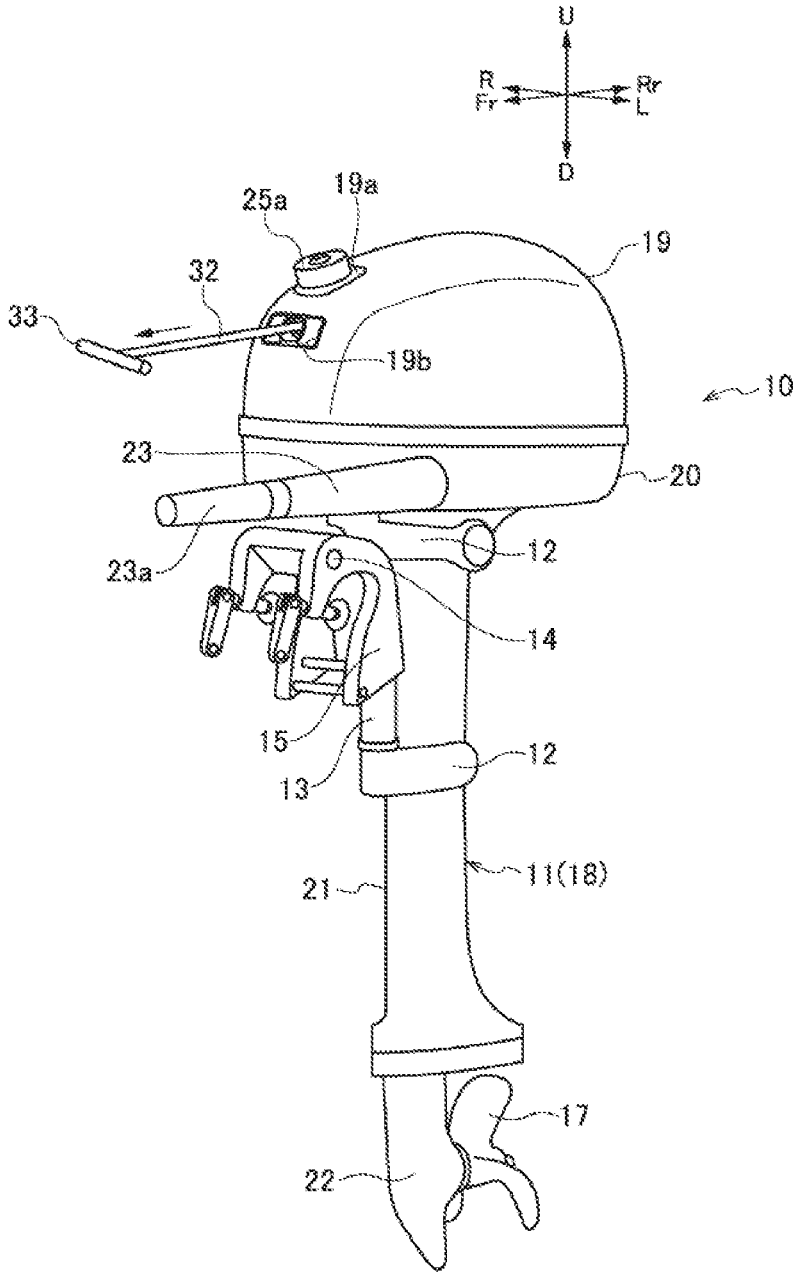
FIG. 1 is an overall perspective view of an outboard motor according to an embodiment of the present invention.

An outboard motor according to an embodiment of the present invention will be described below with reference to the accompany drawings. Incidentally, it is assumed that the drawings are seen in a direction of reference numerals. In the following description, front, rear, left, right, upper and lower directions are taken as a bow of a hull is regarded as a front side. In the drawings, a front side is denoted by Fr, a rear side is denoted by Rr, a left side is denoted by L, a right side is denoted by R, an upper side is denoted by U, and a lower side is denoted by D.

As shown in FIG. 1, an outboard motor 10 includes an outboard motor main body 11, a pair of upper and lower mounting frames 12 mounted on the outboard motor main body 11 via a shock absorbing material (not shown), and a support unit 15 rotatably supporting the mount frame 12 around a swivel shaft 13 and a pitch shaft 14 with respect to the hull (not shown).

Figure 2:
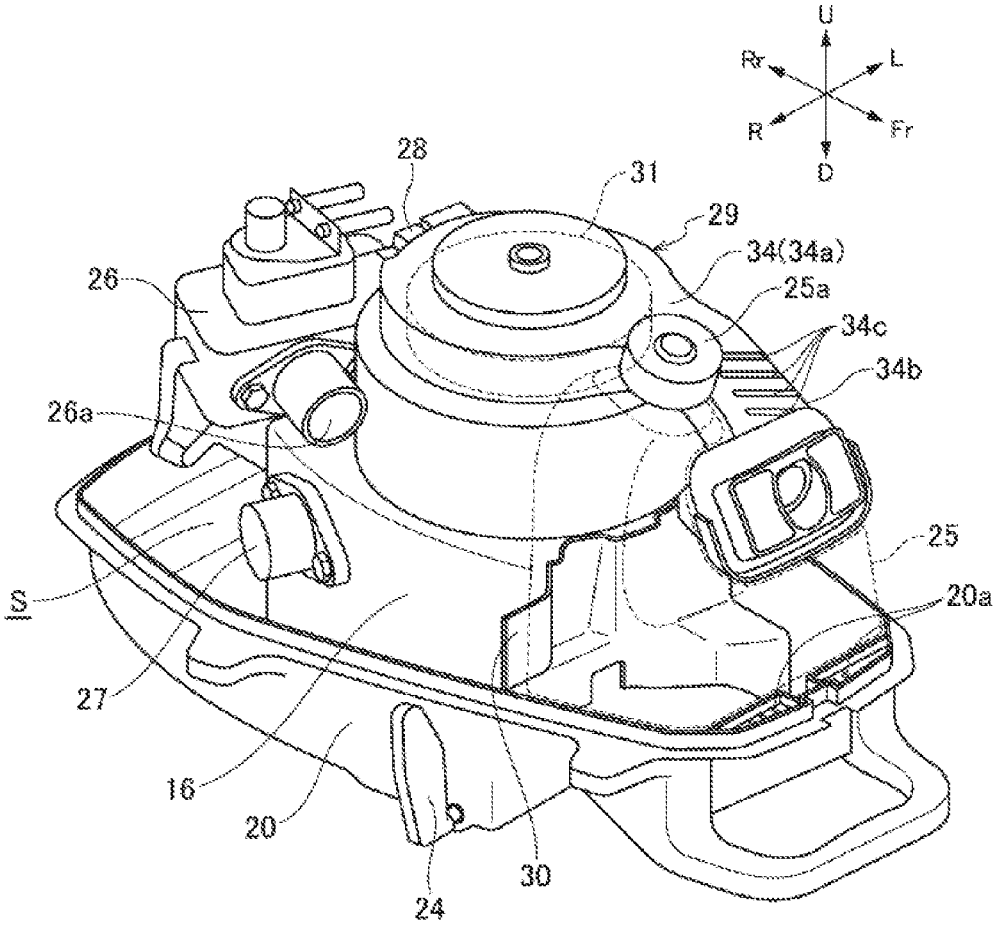
FIG. 2 is an internal perspective view of the outboard motor according to an embodiment of the present invention.

As shown in FIGS. 1 and 2, the outboard motor main body 11 includes a case member 18 supporting the engine 16 at an upper portion thereof and rotatably supporting the propeller 17 at a lower portion thereof, and a cover member 19 mounted on an upper portion of the case member 18 so as to cover an upper side of the engine 16.

The case member 18 includes an under case 20 supporting the engine 16, an extension case 21 extending downward from the under case 20, and a gear case 22 provided at a lower portion of the extension case 21.

Figure 3:
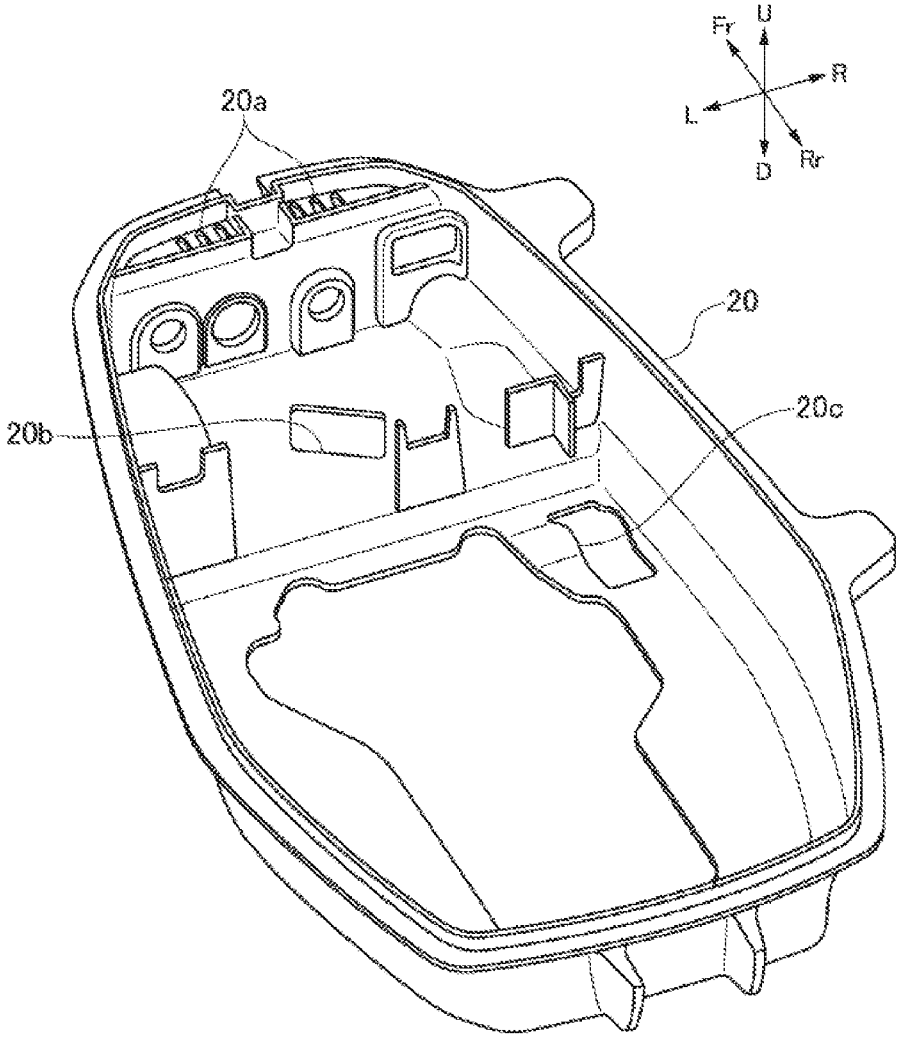
FIG. 3 is a perspective view showing an under case of the outboard motor according to an embodiment of the present invention.

As shown in FIGS. 2 and 3, the under case 20 includes various mounting portions to which the engine 16 and other components are mounted, and air inlets 20*a* to 20*c* which take air into an internal space S covered with the under case 20 and the cover member 19. The under case 20 of the present embodiment includes a first air inlet 20*a* formed on a lower surface of a front end portion, a second air inlet 20*b* formed on a front side and a lower surface of an engine mounting position, and a third air inlet 20*c* formed on one side and a lower surface of the engine mounting position.

As shown in FIG. 1, a steering handle 23 extending forward is provided on a left side surface portion of the under case 20. When the steering handle 23 is operated in a left-right direction, the outboard motor main body 11 rotates around a swivel shaft 13, and the hull is steered. Further, the steering handle 23 includes a throttle grip 23*a* capable of being rotatably operated, and when the throttle grip 23*a* is rotatably operated, the rotation speed of the engine 16 is changed.

As shown in FIG. 2, a shift lever 24 capable of being rotatably operated in a front-rear direction is provided on a right side surface portion of the under case 20. The shift lever 24 is an operating tool for switching a rotation direction of the propeller 17. When the shift lever 24 is in a neutral position as shown in FIG. 2, the power transmission to the propeller 17 is cut off, when the shift lever 24 is operated forward from the neutral position, the propeller 17 rotates normally and the hull moves forward, and when the shift lever 24 is operated backward from the neutral position, the propeller 17 rotates reversely and the hull moves backward.

The extension case 21 is a cylindrical case extending downward from the under case 20, a power transmission shaft (not shown) Which transmits the power of the engine 16 to the gear case 22 is installed thereinside, and the mount frame 12 is mounted to the outside thereof.

The propeller 17 is rotatably supported on the gear case 22, and a shifting gear mechanism (not shown) which transmits the power input from the extension case 21 to the propeller 17 is installed in the gear case 22. The shift gear mechanism is switched among a forward state in which the propeller 17 is rotated normally, a neutral state in which the power transmission to the propeller 17 is disconnected, and a backward state in which the propeller 17 is rotated reversely according to the operation of the shift lever.

As shown in FIG. 2, the engine 16, a fuel tank 25 which stores fuel of the engine 16, a fuel pump 27 which supplies the fuel in the fuel tank 25 to a carburetor 26 of the engine 16, an ignition coil 28 which supplies a high voltage to an ignition plug (not shown) of the engine 16, a recoil starter 29 which manually starts the engine 16 are arranged in the internal space S covered with the under case 20 and the cover member 19.

Specifically, the engine 16 is arranged at a center portion of the internal space S, the fuel tank 25 is arranged at a front side of the engine 16, the fuel pump 27 and an inlet 26*a* of the carburetor 26 are arranged at a right side of the engine 16, an ignition coil 28 is arranged at a rear side of the engine 16, and the recoil starter 29 is arranged at an upper side of the engine 16.

The engine 16 is, for example, a single-cylinder four-cycle engine in which a cylinder is laterally arranged and a crankshaft is vertically arranged, a mixed gas supplied from the carburetor 26 into the cylinder is exploded by the discharge of the ignition plug, and the crankshaft is rotated by an explosive force thereof. Incidentally, although the outboard motor 10 includes an engine cooling mechanism which cools the engine 16 by water cooling or air cooling, the illustration and the description of the engine cooling mechanism are omitted.

The fuel tank 25 includes an oil supply port (not shown) which protrudes to the outside via an opening 19*a* formed in the cover member 19 and is opened and closed by a cap 25*a*. The fuel supplied from the oil supply port is stored in the fuel tank 25 and supplied to the engine 16 via the fuel pump 27.

In the present embodiment, when the fuel tank 25 is arranged at a front side of the engine 16, an insulator 30 which blocks the heat of the engine 16 is arranged between the engine 16 and the fuel tank 25, and an air flow path is secured between a rear surface of the fuel tank 25 and the insulator 30 and between the cover member 19 and a front surface and left and right side surfaces of the fuel tank 25. Accordingly, the fuel tank 25 is cooled by the air taken into the internal space S from the air inlets 20*a* to 20*c* and the temperature rise of the fuel stored in the fuel tank 25 is suppressed.

The fuel pump 27 and the ignition coil 28 are heat generating components which become relatively high in temperature. Since the heat generation of the fuel pump 27 and the ignition coil 28 not only increases the temperature of the internal space S but also causes deterioration and failure of the fuel pump 27 and the ignition coil 28, it is preferable to cool the fuel pump 27 and the ignition coil 28 with the air taken into the internal space S from the air inlets 20*a* to 20*c*.

As shown in FIGS. 1 and 2, the recoil starter 29 includes a starter reel 31 connected to the crankshaft of the engine 16 via a one-way clutch (not shown), a rope 32 connected to the starter reel 31 and wound around the starter reel 31 by an energizing force of a spring (not shown), a starter grip 33 provided at a tip end portion of the rope 32, and a recoil cover 34 covering the starter reel 31. Then, when the rope 32 is pulled by grasping the starter grip 33 exposed to the outside of the cover member 19, the crankshaft rotates together with the starter reel 31, and the engine 16 is started.

The recoil cover 34 includes a recoil cover main body 34*a* covering the starter reel 31 and an extension portion 34*b* extending forward from the recoil cover main body 34*a*. The extension portion 34*h* is formed in a cylindrical shape such that the rope 32 can be inserted therethrough, and the tip end portion thereof is exposed to the outside through an opening portion 19*b* formed in the cover member 19 and can be locked with the starter grip 33.

Figure 4:
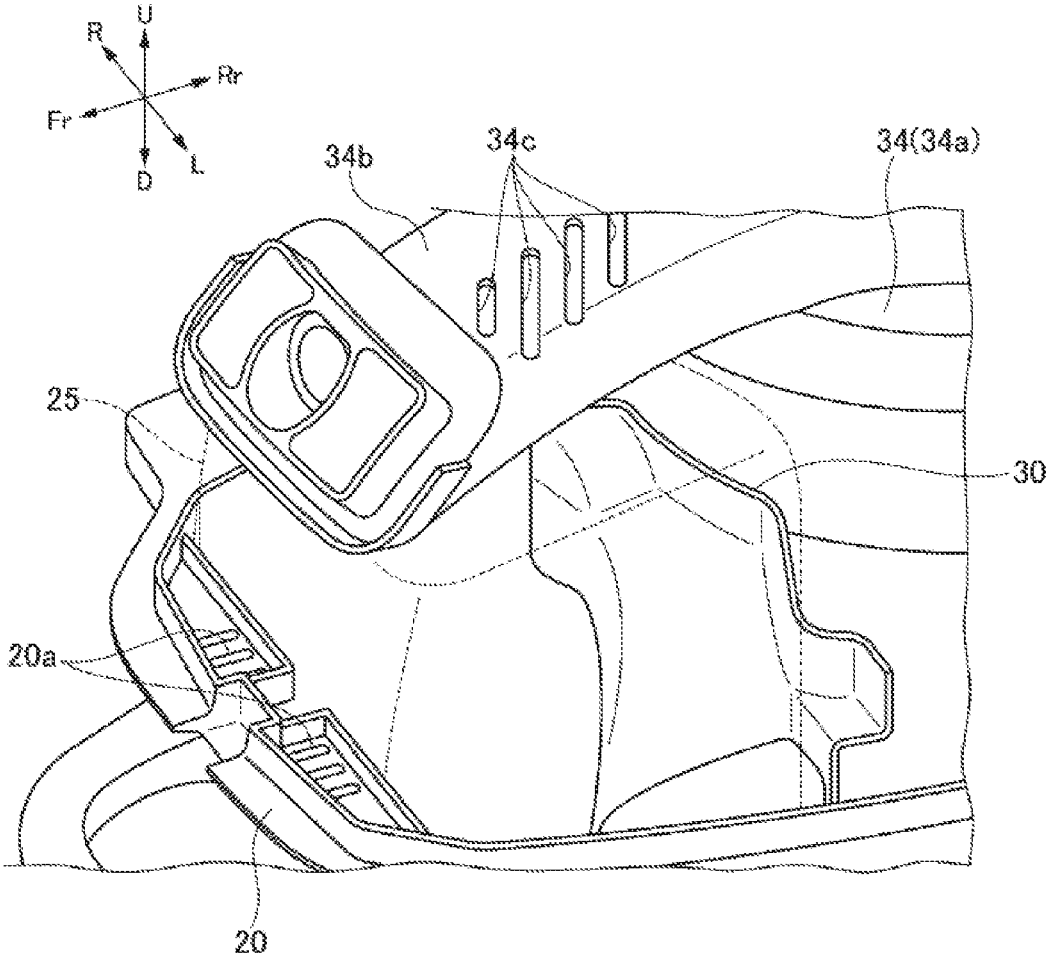
FIG. 4 is a partial perspective view showing air passage holes formed in a recoil cover of the outboard motor according to an embodiment of the present invention.

As shown in FIGS. 2 and 4, since the extension portion 34*b* of the recoil cover 34 covers at least a part of an upper side of the fuel tank 25, there is a possibility that the air taken into the internal space S from the first air inlet 20*a* and the second air inlet 20*b* strikes on the extension portion 34*b* and stagnates. Therefore, the extension portion 34*b* is formed with air passage holes 34*c* allowing passage of air. Specifically, the air passage holes 34*c* has a plurality of parallel slit holes and are formed in a lower surface and an upper surface of the extension portion 34*h* facing the fuel tank 25.

Next, the air flow taken into the internal space S from the air inlets 20*a* to 20*c* will be described with reference to FIG. 5.

Figure 5:
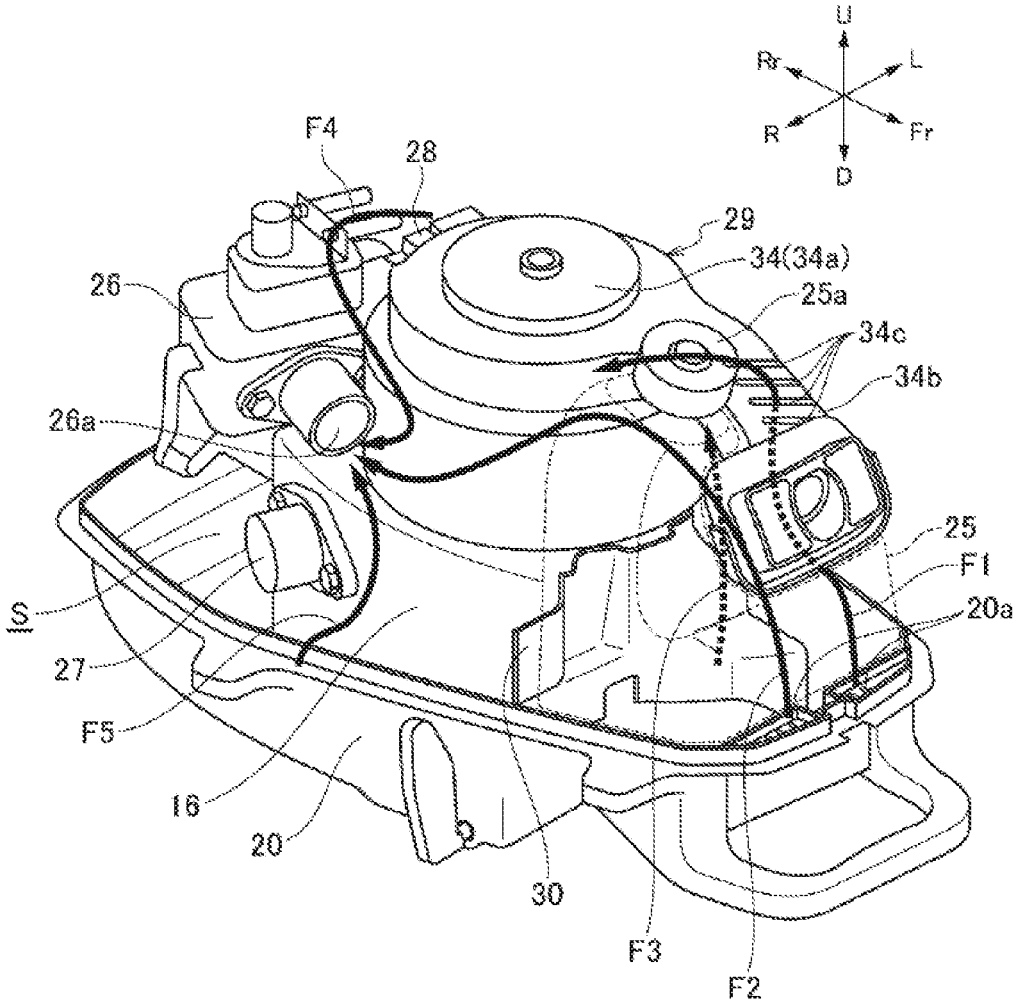
FIG. 5 is an internal perspective view showing an air flow inside the outboard motor according to an embodiment of the present invention.

As shown in FIG. 5, in the internal space S of the outboard motor 10, air is taken from the three air inlets 20*a* to 20*c* according to the suction of air by the carburetor 26. Air (F1, F2) taken from the first air inlet 20*a* cools the fuel tank 25 by passing through a space between the fuel tank 25 and the cover member 19 and then flows into a center portion of the internal space S. A part of the air (F1) enters a gap between the fuel tank 25 and the extension portion 34*h* of the recoil cover 34, the remaining air (F2) flows into the center portion of the internal space S without entering the gap between the fuel tank 25 and the extension portion 34*b* of the recoil cover 34. The air (F1) which enters the gap between the fuel tank 25 and the extension portion 34*b* of the recoil cover 34 flows into the center portion of the internal space S via the air passage holes 34*c*. Conventionally, the air (F1) which enters the gap between the fuel tank 25 and the extension portion 34*b* of the recoil cover 34 stagnates in this gap. However, since the extension portion 34*h* of the present embodiment is formed with the air passage holes 34*c*, the air (F1) which flows into this gap cools the fuel tank 25 and then flows into the center portion of the internal space S via the air passage holes 34*c* without stagnating.

Air (F3) taken from the second air inlet 20*b* cools the fuel tank 25 by passing through a space between the fuel tank 25 and the insulator 30 and then flows into a center portion of the internal space S.

A part of the air (F4) taken from the first air inlet 20*a* and the second air inlet 20*b* and flowing toward the center portion of the internal space S cools the ignition coil 28 by passing through a rear side of the recoil cover 34 and is suctioned into the carburetor 26, and the remaining air flows toward a front side of the recoil cover 34 and is suctioned into the carburetor 26. Further, air (F5) taken from the third air inlet 20*c* cools the fuel pump 27 arranged in the vicinity of the third air inlet 20*c*, and then is suctioned into the carburetor 26.

As described above, according to the outboard motor 10 of the present embodiment, since the air taken inside the cover member 19 is supplied to the carburetor 26 of the engine 16 through the air passage holes 34*c* of the recoil cover 34, it is possible to suppress stagnation of the air due to the recoil cover 34 and efficiently cool components accommodated inside the cover member 19.

Further, since the recoil cover 34 includes the extension portion 34*b* which covers at least a part of the upper side of the fuel tank 25, and the air passage holes 34*c* are provided in the extension portion 34*h*, it is possible to suppress the stagnation of the air due to the extension portion 34*h* of the recoil cover 34 and efficiently cool the components accommodated inside the cover member 19.

Further, the extension portion 34*b* of the recoil cover 34 is formed in a tubular shape such that the rope 32, one end of which is connected to the starter reel 31 of the recoil starter 29, can be inserted therethrough, and since the air passage holes 34*c* are formed in the surface of the extension portion 34*b* facing the fuel tank 25 and the upper surface of the extension portion 34*h*, it is possible to reliably suppress the stagnation of air by the extension portion 34*b* of the recoil cover 34.

Incidentally, the present invention is not limited to the above-described embodiment and may be appropriately modified, improved, or the like.

For example, in the above embodiment, the air passage holes 34*c* are configured by a plurality of parallel slit holes, but the present invention is not limited thereto, and the air passage holes 34*c* may be configured by one or more openings, meshes, punching, or the like.

DESCRIPTION OF REFERENCE NUMERALS

10 outboard motor
16 engine
17 propeller
18 case member
19 cover member
25 fuel tank
29 recoil starter
31 starter reel
32 rope
34 recoil cover
34*b* extension portion
34*c* air passage hole

The invention claimed is:

1. An outboard motor comprising:

an engine;

a fuel tank;

a propeller which is configured to be driven by the engine;

a case member which rotatably supports the propeller;

a recoil starter which is configured to cause the engine to start by manually rotating a crankshaft of the engine; and a cover member which is mounted on the case member so as to cover the engine, the fuel tank, and the recoil starter, wherein the recoil starter includes a recoil cover, wherein the recoil cover includes an extension portion which covers at least a part of an upper side of the fuel tank, wherein the extension portion is formed with an air passage hole, wherein the extension portion is formed in a tubular shape such that a rope, one end of which is connected to a starter reel of the recoil starter, can be inserted therethrough, and wherein the air passage hole is formed in a surface of the extension portion facing the fuel tank and an upper surface of the extension portion.

2. The outboard motor according to claim 1, wherein the fuel tank is arranged at a front side of the engine, wherein an insulator which blocks heat of the engine is arranged between the engine and the fuel tank, wherein an air flow path is formed between a rear surface of the fuel tank and the insulator, and wherein another air flow path is formed between the cover member and a front surface and left and right side surfaces of the fuel tank.

3. The outboard motor according to claim 1, further comprising:

a fuel pump which is configured to supplying fuel in the fuel tank to the engine; and an ignition coil configured to supply a high voltage to an ignition plug of the engine wherein the fuel pump and the ignition coil are provided in an internal space covered with the case member and the cover member, wherein the case member is formed with an air inlet which takes air into the internal space, and wherein the fuel pump and the ignition coil are cooled by the air taken into the internal space from the air inlet.

4. The outboard motor according to claim 1, wherein the air passage hole includes a plurality of parallel slit holes.

* * * * *